United States Patent [19]

Lee

[11] 4,292,877

[45] Oct. 6, 1981

[54] AMMUNITION LOADER WITH IMPROVED CHARGE BAR

[76] Inventor: Richard J. Lee, Highway "U", Hartford, Wis. 53027

[21] Appl. No.: 734,397

[22] Filed: Oct. 21, 1976

[51] Int. Cl.[3] ..... F42B 33/02

[52] U.S. Cl. ..... 86/31; 86/23; 86/29

[58] Field of Search ..... 86/23–33; 308/1 A, 237, 238

[56] References Cited

U.S. PATENT DOCUMENTS

| | | | |
|---|---|---|---|
| 2,820,392 | 1/1958 | Schmidt | 86/33 |
| 3,361,024 | 1/1968 | Sherrill, Jr. | 86/31 |
| 3,450,000 | 6/1969 | Ponsness | 86/30 |
| 3,752,033 | 8/1973 | Ross | 86/31 |

FOREIGN PATENT DOCUMENTS

| | | | |
|---|---|---|---|
| 329693 | 2/1903 | France | 86/31 |

*Primary Examiner*—Harold J. Tudor

*Attorney, Agent, or Firm*—Andrus, Sceales, Starke & Sawall

[57] ABSTRACT

An ammunition loader has hoppers for shot and/or powder, and a slideable charge bar for metering shot and powder from the hoppers to the shell. Metering bushings are selectively disposed in the charge bar. A leakage opening in the side wall of the charge bar communicates with the outside of the assembly. The opening is blocked when a bushing is in place, but permits shot or powder to spill therethrough if no bushing is present. The bushings have exposed volume indicating indicia thereon.

14 Claims, 8 Drawing Figures

Fig. 1
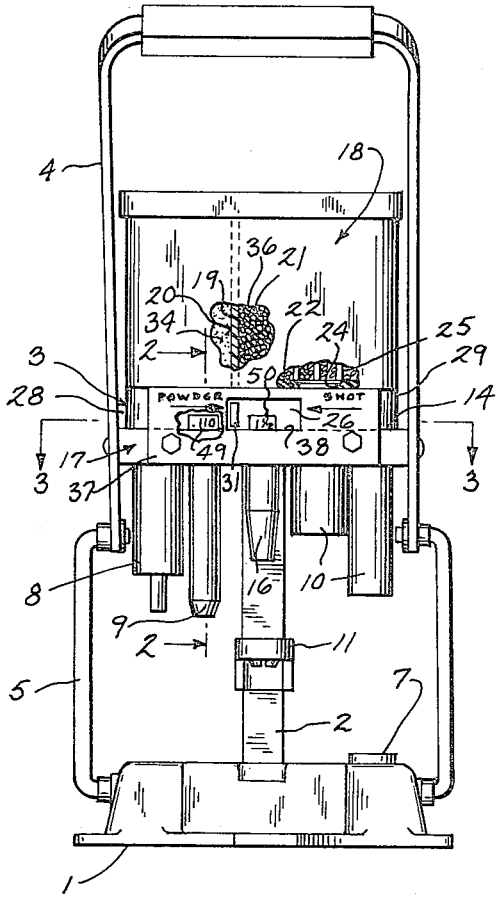
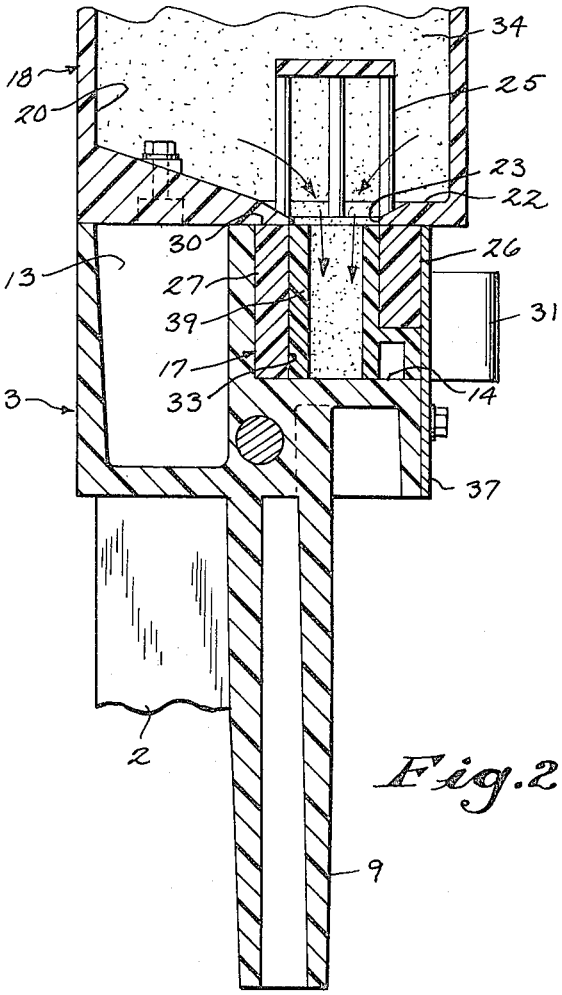
Fig. 2
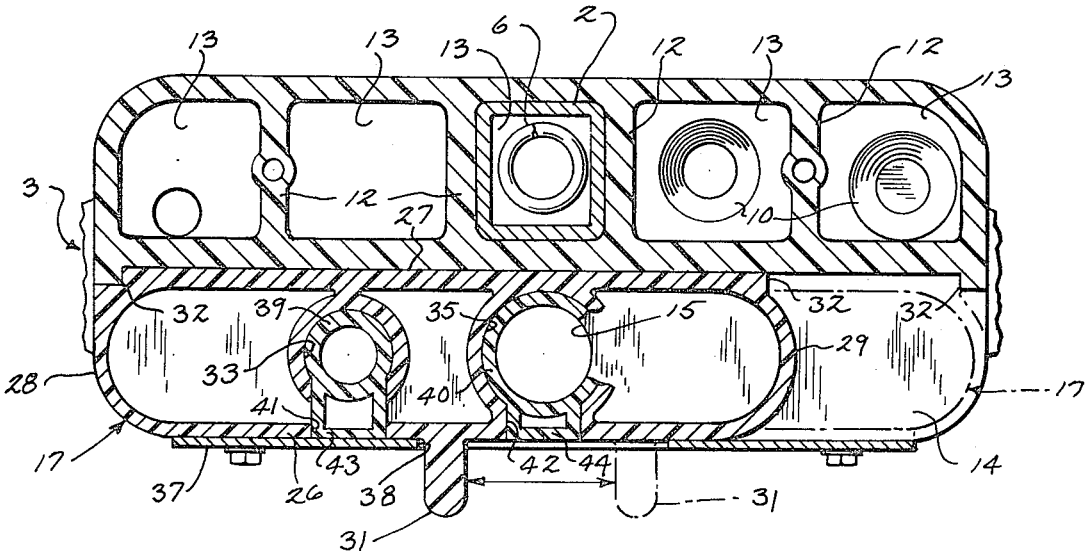
Fig. 3

AMMUNITION LOADER WITH IMPROVED CHARGE BAR

BACKGROUND AND SUMMARY OF THE INVENTION

This invention relates to an ammunition loader with an improved charge bar.

In the art of loading spent ammunition such as shotgun shells, it is already known to provide a vertically movable device having hoppers for shot and powder, a slideable charge bar for providing metered amounts of shot and powder; and dies for sizing, priming and crimping the shell, as well as a filler tube for feeding the metered shot and powder into the shell.

The charge bar has included closed side walls and vertical openings to receive selected sizes of bushings, with the latter receiving and determining the metered amount of the charge of shot and powder. Sliding of the charge bar between several positions has caused the shot or powder to flow into the bushing from a hopper and to be subsequently discharged through the filler tube.

It is well known that loading and reloading ammunition requires great care and attention to reduce the dangers involved. For example, it is important that bushings be placed into the above-mentioned charge bar openings, lest too much shot or powder be fed into the shell.

The present invention is based on a unique concept of charge bar construction wherein shot or powder cannot be fed to the shell unless a bushing is in place in the charge bar. Broadly, this is accomplished by providing a leakage opening in the wall of the charge bar and which communicates with the outside of the assembly. The opening is blocked when a bushing is in place, but permits shot or powder to spill therethrough if no bushing is present.

In accordance with one embodiment of the invention, at least one leakage opening is provided at the lower edge of the charge bar side wall and a radial projection on the bushing normally blocks the opening.

In accordance with another embodiment of the invention, at least one leakage opening is provided in the charge bar sidewall and about midway between the upper and lower edges thereof, and the bushing wall itself normally blocks the opening.

In accordance with another aspect of the invention, indicia are provided on each bushing in a manner so that it is visually observable when the bushing is installed. The indicia are for the purpose of indicating the amount of shot or powder which will be metered when that particular bushing is used.

BRIEF DESCRIPTION OF THE DRAWINGS

The accompanying drawings illustrate the best modes presently contemplated by the inventor for carrying out the invention.

In the drawings:

FIG. 1 is a front elevation of a shotgun shell reloader incorporating the concept of the invention, with a portion of the front panel broken away;

FIG. 2 is a vertical section taken on line 2—2 of FIG. 1;

FIG. 3 is a horizontal section taken on line 3—3 of FIG. 1;

DESCRIPTION OF THE PREFERRED EMBODIMENTS

Figure 4:
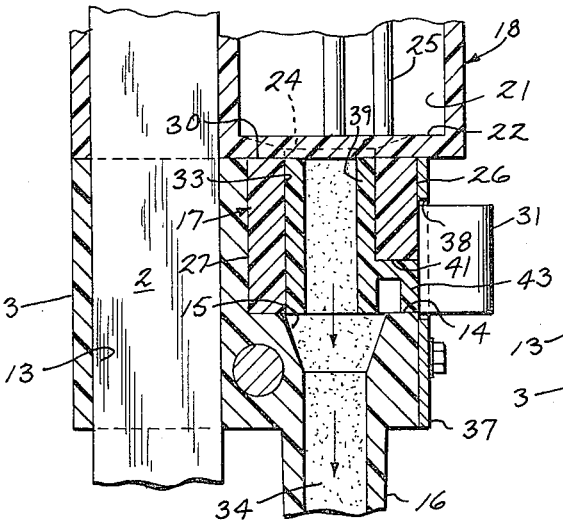
FIG. 4 is a fragmentary central vertical section of the reloader, showing a bushing in place and with the charge bar moved to the right to deliver metered powder to the filler tube.

As shown in FIG. 1 of the drawings, the invention is embodied in a shotgun shell reloader having a base 1, a vertical column 2 extending upwardly from the rear of the base, a loading assembly including a head member 3 mounted for vertical sliding movement on the column; and a handle 4 and lever 5 pivotally arranged so that movement of handle 4 causes raising or lowering of head member 3. A spring 6, shown in FIG. 3, normally biases head member 3 to its topmost position.

A plurality of shotgun shell receiving stations 7 are disposed in base 1, only one station being shown in FIG. 1. Stations 7 are adapted to cooperate with suitable dies in working on the shell. For example, in FIG. 1 there are shown a depriming die 8, a priming die 9, and several crimping dies 10. In addition, a wad guide 11 is mounted to column 2.

Dies 8–10 may be integral with and extend downwardly from head member 3. The latter member is generally L-shaped in side elevation or section. Its rearward upright portion is generally hollow with strengthening ribs 12 forming chambers 13, one of which receives column 2 therethrough as shown in FIG. 3.

The front portion of head member 3 comprises a forwardly extending elongated platform or floor 14 having a central feed opening 15 therein which communicates downwardly through a filler tube 16, for purposes to be described. Floor 14 is adapted to support a material transferring charge bar 17 which is slideable back and forth thereon.

A hopper unit 18 is suitably mounted atop the rearward portion of head member 3. Unit 18 is the source for receiving and storing shell loading material, namely shot and/or powder. In the present embodiment, hopper unit 18 is divided by a partition 19 into a powder storing compartment 20 and a shot storing compartment 21. The floor 22 of hopper unit 18 extends forwardly over floor 14 so that charge bar 17 is loosely confined therebetween. In the forward portion of each compartment 20,21, floor 22 contains spaced discharge openings 23, 24 respectively. These latter openings are disposed above floor 14 and charge bar 17, and their vertical axes are disposed on each side of feed opening 15. A flow enhancing member 25 is disposed above each opening 23,24.

Charge bar 17 is adapted to selectively meter the amount of shot and powder fed to the shotgun shell from hopper unit 18. For this purpose, and in the present embodiment, charge bar 17 comprises an elongated body having vertical front and rear side walls 26,27 joined by curved end walls 28, 29, and a planular top wall 30. A handle 31 extends forwardly from front wall 26 for manually sliding charge bar 17 back and forth along floor 14, the end limits of movement being defined by mutually engageable shoulders 32 on charge bar 17 and on the rear portion of head member 3. See FIG. 3.

In the present embodiment, charge bar 17 is generally hollow, but is provided with a pair of sleeve-like vertical passages extending therethrough, one passage 33 being for powder 34 and the other passage 35 being for shot 36. Passages 33 and 35 are spaced farther apart than the diameter of feed opening 15, and their maximum extent is less than the distance between hopper openings 23 and 24. Powder passage 33 is usually somewhat smaller in cross section that shot passage 35.

Charge bar 17 is held in place and prevented from falling fowardly by a retainer plate 37 having an opening 38 therein for receiving handle 31. Plate 37 is shown as having the words "Powder" and "Shot" thereon, together with appropriate arrows to indicate the direction of movement of handle 31 to transfer and discharge the respective material into feed opening 15.

It is, of course, well-known that shotgun shells require different amounts of shot and/or powder. Therefor, passages 33 and/or 35 are adapted to slidingly receive a removable bushing therein which has an outside diameter approximately equal to the diameter of the respective passage, and has a smaller inside diameter. In the present embodiment, both passages 33 and 35 have sizing and metering bushings 39, 40 respectively therein. These bushings may be selectively replaced with other bushings of a desired different inside diameter.

Briefly, charge bar 17 operates as follows:

When charge bar 17 is centered so that handle 31 is centered in plate opening 38, the upper ends of passages 33 and 35 are out of registry with hopper openings 23 and 24, and the lower ends of passages 33 and 35 are also out of registry with feed opening 15. Hopper compartments 20 and 21 can then be filled with the respective powder and shot, which are blocked from discharge by the face of charge bar top wall 30.

As shown in FIGS. 1–3, when charge bar 17 is shifted to the left, the upper end of passage 33 moves into registry with powder discharge opening 23 so that powder flows into the metering chamber defined by bushing 39 and floor 14 of head member 3. At the same time, the lower end of empty passage 35 registers with feed opening 15.

When a shell is placed in wad guide 11 and is ready for filling, handle 4 is lowered and charge bar 17 is moved all the way to the right, in the direction of the arrow adjacent the word "Powder" on plate 37. This causes the lower end of passage 33 to move into registry with feed opening 15 so that a metered charge of powder drops through filler tube 16 and into the shell as shown in FIG. 4. At the same time, the upper end of passage 35 registers with shot discharge opening 24 so that shot flows into the metering chamber defined by bushing 40 and floor 14 of head member 3.

To load the shell with shot, charge bar 17 is then again moved all the way to the left in the direction of the arrow adjacent the word "Shot" on plate 37. This causes the lower end of passage 35 to move into registry with feed opening 15 so that a metered charge of shot drops through filler tube 16 and into the shell. The upper end of passage 33 registers with opening 23 and is refilled, and is ready for the loading of the next shell.

It is very important that the amount of shot and powder received, held and discharged from the metering chambers into the shell be the correct amount for that particular shell. Thus, if a bushing 39 or 40 is accidentally not installed in the respective passage 33 or 35, the resultant metering chamber will be substantially larger than desired and will result in too much shell loading material being loaded into the shell.

Heretofore, the installed bushings 39, 40 were not visible to the operator and the entire charge bar assembly had to be removed to determine whether bushings had been installed or not.

Broadly in accordance with one aspect of the invention, means are provided to leak or spill shell loading material out of the charge bar if a bushing is not in place. For this purpose, front wall 26 of charge bar 17 is provided with a leakage opening which communicates with each metering passage which is to be made variable in volume by use of a bushing; and the bushing, when present, blocks the leakage opening.

As shown in the embodiment of FIGS. 1–6, the lower edge portion of front wall 26 is notched to provide leakage openings 41, 42, said openings extending through the walls of the respective passages 33,35 so that the interior of the passages communicates with the outside. In addition, bushings 39 and 40 are provided with means to block the leakage openings. For this purpose, a radial projection 43,44 is formed on the respective bushing. When the bushings are installed in their respective passages, projections 43, 44 extend outwardly through openings 41, 42 and are visible.

Figure 5:
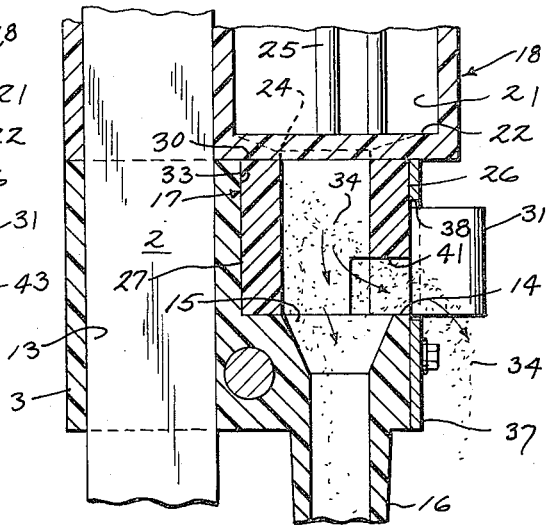
FIG. 5 is a view similar to FIG. 4 and with the bushing removed.
Figure 6:
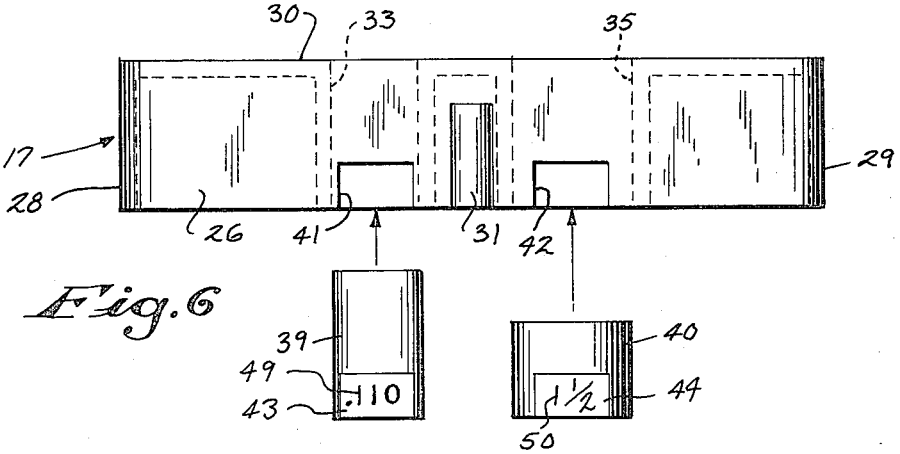
FIG. 6 is a front elevation of the charge bar of FIGS. 1–5.

Referring to FIG. 4, when bushing 39 is installed in passage 33, projection 43 extends outwardly through opening 41, and blocks the latter so that powder 34 can only be discharged from the metering chamber through filler tube 16. However, and as shown in FIG. 5, if bushing 40 has not been installed in charge bar 17, opening 41 will be exposed and, when charge bar 17 is shifted to the right, a substantial amount of powder 34 will spill outwardly through the opening and the operator will be immediately warned as to the lack of a bushing. The structure and operation is similar on the "Shot" side of the charge bar.

Figure 7:
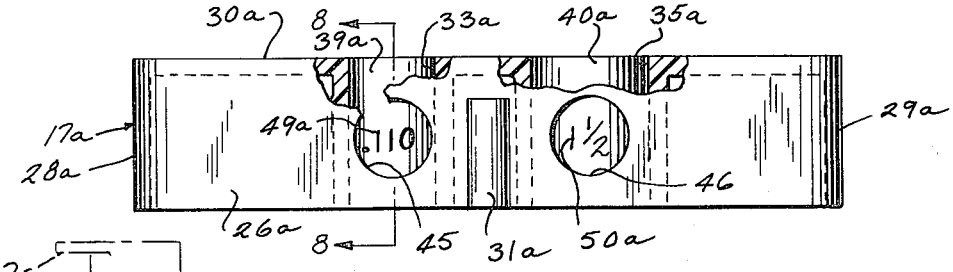
FIG. 7 is a front elevation of a second embodiment of charge bar.
Figure 8:
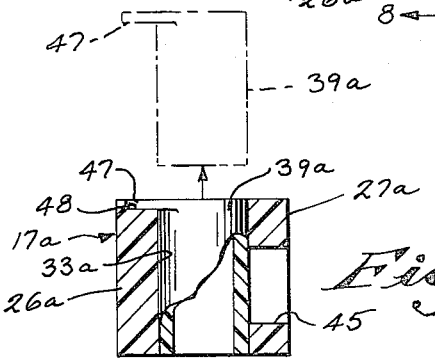
FIG. 8 is a sectional view taken on line 8—8 of FIG. 7.

In the embodiment of FIGS. 7 and 8, a pair of uninterrupted openings 45, 46 are disposed in front wall **26*a* of charge bar 17*a*, said openings communicating directly with the respective passages 33*a*, 35*a*. In this instance, the side walls of bushings 39*a*, 40*a*** provide the opening blocking means and are visible. Lack of a bushing will cause the shell loading material to spill out through the adjacent opening.

FIG. 8 shows that the bushing **39*a* is held in place and prevented from rotating by a lip 47 which is seated in a depression 48 in the main bushing body. Bushing 40*a* would have the same structure, not shown. A similar function is provided by the projections 43, 44** of the first embodiment.

In accordance with another aspect of the invention, the portion of the bushings which block the leakage openings have visible indicia thereon which indicate the amount of shot or powder which will be metered (internally held by the bushing) when that particular bushing is used.

In the embodiment of FIGS. 1–6, the outer ends of projections 43 and 44 are flat and flush with the outer face of front wall 26. The indicia 49, 50 are disposed on the flat projection faces, indicia 49 indicating the cubit inch volume of metered powder; and indicia 50 indicating the weight of metered shot, which of course is dependent on volume also.

In the embodiment of FIGS. 7 and 8, the indicia **49*a*, 50*a* are disposed directly on the side wall of the respective bushings 39***a*, 40*a*, and function in the same manner as in the first embodiment.

In both embodiments, bushings of different varying volumes would have different indicia thereon, so that the proper size bushings can be selected for the particular size shell, and the wrong size bushing would be immediately apparent.

The concepts of the present invention provide a unique low-cost safety improvement for ammunition loaders for the shells of shotguns, rifles, pistols and the like.

Various modes of carrying out the invention are contemplated as being within the scope of the following claims particularly pointing out and distinctly claiming the subject matter which is regarded as the invention.

I claim:

1. In an ammunition loader:

(a) a head member having a feed opening therein, (b) a hopper for containing shell loading material and with said hopper having a discharge opening disposed above said head member, (c) a movable charge bar disposed between said feed opening and said discharge opening and with said charge bar having a passage adapted to selectively receive shell loading material from said discharge opening and to transfer said material to said feed opening, (d) a sizing and material metering bushing adapted to be removably disposed in said passage; said bushing being adapted to receive, hold and discharge shell loading material therefrom, (e) and means for spilling said shell loading material out of said passage when said bushing is not disposed in the latter, (f) said material spilling means comprising a leakage opening communicating between said passage and the outside of said charge bar, said leakage opening being blocked by said bushing when the latter is disposed in said passage.

2. The ammunition loader of claim 1:

(a) wherein said leakage opening includes a notch disposed in an edge of said passage, (b) and said bushing includes an outwardly extending radial projection which is disposed within said notch when said bushing is disposed in said passage.

3. The ammunition loader of claim 2 which includes exposed indicia disposed on said projection for indicating the metering volume of said bushing.

4. The ammunition loader of claim 1:

(a) wherein said leakage opening is disposed in the wall of said passage, (b) and said bushing includes a wall portion which blocks said opening when said bushing is disposed in said passage.

5. The ammunition loader of claim 4 which includes exposed indicia disposed on the said wall portion of said bushing for indicating the internal metering volume of the latter.

6. In an ammunition loader:

(a) a head member with said head member having a feed opening therein, (b) a hopper for containing shell loading material and with said hopper having a discharge opening disposed above said head member, (c) a movable charge bar disposed between said feed opening and said discharge opening and with said charge bar having a passage adapted to selectively receive shell loading material from said discharge opening and to transfer said material to said feed opening, (d) a sizing and material metering bushing adapted to be removably disposed in said passage; said bushing being adapted to receive, hold and discharge shell loading material therefrom, (e) exposed indicia disposed on said bushing for indicating the internal metering volume of said bushing, (f) and a notch disposed in an edge of said passage, (g) said bushing including a projection disposed within said notch and having said indicia thereon.

7. In an ammunition loader:

(a) a head member with said head member having a feed opening therein, (b) a hopper for containing shell loading material and with said hopper having a discharge opening disposed above said head member, (c) a movable charge bar disposed between said feed opening and said discharge opening and with said charge bar having a passage adapted to selectively receive shell loading material from said discharge opening and to transfer said material to said feed opening, (d) a sizing and material metering bushing adapted to be removably disposed in said passage; said bushing being adapted to receive, hold and discharge shell loading material therefrom, (e) exposed indicia disposed on said bushing for indicating the internal metering volume of said bushing, (f) and an opening disposed in the wall of said passage, (g) a wall portion of said bushing adjacent said opening having said indicia thereon.

8. For use in an ammunition loader:

(a) a movable charge bar having a passage adapted to selectively receive shell loading material from a source thereof and to transfer said material for filling a shell, (b) a sizing and material metering bushing adapted to be removably disposed in said passage; said bushing being adapted to receive, hold and discharge shell loading material therefrom, (c) and means for spilling said shell loading material out of said passage when said bushing is not disposed in the latter, (d) said material spilling means comprising a leakage opening communicating between said passage and the outside of said charge bar, said leakage opening being blocked by said bushing when the latter is disposed in said passage.

9. The device of claim 8:

(a) wherein said leakage opening includes a notch disposed in an edge of said passage, (b) and said bushing includes an outwardly extending radial projection which is disposed within said notch when said bushing is disposed in said passage.

10. The device of claim 9 which includes exposed indicia disposed on said projection for indicating the internal metering volume of said bushing.

11. The device of claim 8:

(a) wherein said leakage opening is disposed in the wall of said passage, (b) and said bushing includes a wall portion which blocks said opening when said bushing is disposed in said passage.

12. The device of claim 11 which includes exposed indicia disposed on the said wall portion of said bushing for indicating the internal metering volume of the latter.

13. For use in an ammunition loader:

(a) a movable charge bar having a passage adapted to selectively receive shell loading material from a source thereof and transfer said material for filling a shell, (b) a sizing and material metering bushing adapted to be removably disposed in said passage; said bushing being adapted to receive, hold and discharge shell loading material therefrom, (c) exposed indicia disposed on said bushing for indicating the internal metering volume of said bushing, (d) and a notch disposed in an edge of said passage, (e) said bushing including a projection disposed within said notch and having said indicia thereon.

14. For use in an ammunition loader:

(a) a movable charge bar having a passage adapted to selectively receive shell loading material from a source thereof and transfer said material for filling a shell, (b) a sizing and material metering bushing adapted to be removably disposed in said passage; said bushing being adapted to receive, hold and discharge shell loading material therefrom, (c) exposed indicia disposed on said bushing for indicating the internal metering volume of said bushing, (d) and an opening disposed in the wall of said passage, (e) a wall portion of said bushing adjacent said opening having said indicia thereon.

* * * * *